United States Patent [19]

Fujii et al.

[11] Patent Number: 4,964,254

[45] Date of Patent: Oct. 23, 1990

[54] CROSSPIECE SUPPORTING PAD IN STRUCTURAL CONSTRUCTION

[75] Inventors: Hirokazu Fujii, Kyoto; Fumio Yoshida, Osaka, both of Japan

[73] Assignee: Nitta Industries Corporation, Osaka, Japan

[21] Appl. No.: 748,681

[22] Filed: Jun. 25, 1985

[30] Foreign Application Priority Data

Jul. 26, 1984 [JP] Japan ..... 59-114373[U]

[51] Int. Cl.[5] ..... E04B 1/62

[52] U.S. Cl. ..... 52/396; 248/603

[58] Field of Search ..... 52/167, 396, 403, 573; 14/16.1; 248/632, 634

[56] References Cited

U.S. PATENT DOCUMENTS

| | | | |
|---|---|---|---|
| 2,680,259 | 6/1954 | Milk | 52/573 |
| 4,117,637 | 10/1978 | Robinson | 52/167 |
| 4,823,822 | 4/1989 | Maya | 135/87 |

FOREIGN PATENT DOCUMENTS

| | | | |
|---|---|---|---|
| 1459949 | 1/1970 | Fed. Rep. of Germany | 52/167 |
| 2825606 | 1/1979 | Fed. Rep. of Germany | 52/167 |
| 310087 | 7/1971 | U.S.S.R. | 248/663 |

*Primary Examiner*—Henry E. Raduazo
*Assistant Examiner*—Creighton Smith
*Attorney, Agent, or Firm*—Koda & Androlia

[57] ABSTRACT

A crosspiece supporting pad in a structural construction member including a resilient member having concavely curved surfaces on its upper and lower sides, and a pair of rigid members each having a convexly curved surface which mates with the concavely curved surfaces of the resilient member. The rigid members are respectively fixed to the upper and lower sides of the resilient member with their convexly curved surfaces respectively held in mating relation with the concavely curved surfaces of the resilient member. The pad has sufficient strength to support a crosspiece in expansion joints and adequately absorbs displacement occuring at the ends of the crosspiece due to a live load and further restrains compressive deformation due to the live load.

6 Claims, 3 Drawing Sheets

CROSSPIECE SUPPORTING PAD IN STRUCTURAL CONSTRUCTION

BACKGROUND OF THE INVENTION

1. Field of the Invention

This invention relates to a structural construction members such as support members for PC (precast concrete) beams, and bridge supporting members, and more particularly, to improvements in a crosspiece supporting pad for expansion joint means provided in a structural construction member.

2. Prior Art

Crosspiece supporting pads conventionally used in expansion joints are generally designed such that they are of a mere plate-form construction including solely a resilient material such as polyurethane rubber or the like, or of a combination of polyurethane rubber or the like and rigid synthetic resin plate or steel plate integrally shaped together. With recent increases in heavy weight vehicles on the street, the support pads of these types have difficulties. They are often insufficient in strength and unable to endure repeated fatigue with respect to their material and construction, because the expansion joints are subject to more frequent exertion of live loads than ever.

SUMMARY OF THE INVENTION

This invention has been made to overcome the aforementioned difficulties in the prior art support pad.

A primary object of the invention is to provide a pad which has sufficient strength to support a crosspiece in expansion joints and is able to adequately absorb displacement which occurs at the end of the crosspiece due to a live load and further to restrain a compressive deformation derived from the live load.

In order to overcome the aforementioned difficulties, this invention employs a specific structure including a resilient member having concavely curved surfaces on its upper and lower sides, and a pair of rigid members each having a convexly curved surface which fits the concavely curved surfaces of the resilient member, the rigid members being respectively fixed to the upper and lower sides of the resilient member with their convexly curved surfaces respectively held in mating relation with the concavely curved surfaces of the resilient member.

The term "curved surface" used herein refers to a smoothly curved surface, such as spherical surface, cylindrical surface, or the like.

DETAILED DESCRIPTION OF THE INVENTION

Figure 1:
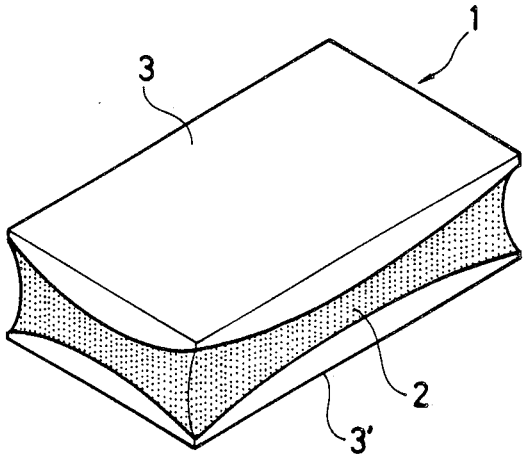
FIG. 1 is a perspective view showing a crosspiece supporting pad in a structural construction member which represents one embodiment of the invention.
Figure 2:
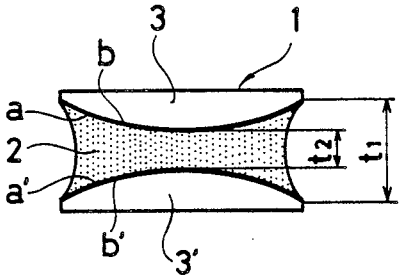
FIG. 2 is an explanatory view showing a thickness ratio between the outer edge portion of a resilient member and the inner central portion thereof.

The supporting pad according to the invention has the following function:

A displacement caused to the ends of a crosspiece by a live load exerted thereon is adequately absorbed by the curved surfaces held in mating and contact relation with each other. Further, since the volume of the resilient member is reduced in its central portion, any compressive deformation can be restrained. Thus, a strength sufficient to sustain live loads is ensured.

One embodiment of the invention will now be described in detail with reference to the accompanying drawings.

Numeral 1 designates a pad in accordance with the invention. The pad includes resilient member 2 having upper and lower sides formed respectively into concavely spherical surfaces a and a' with an apex of said upper spherical surface a lying above an apex of lower spherical surface a'. The pad 1 further includes a rigid member 3 and 3'. The rigid member 3 has a convexly spherical surface b which meets the concavely spherical upper surface a, and the rigid member 3' has a convexly spherical surface b' which meets the concavely spherical surface a'. Furthermore, the apexes of the concavely and convexly spherical surfaces of the resilient member 2 and rigid member 3 and 3' are respectively provided above and below the apexes of the mating spherical surfaces. The rigid members 3 and 3' are fixed respectively to the upper and lower surfaces of the resilient member 2.

Fixing the rigid members 3 and 3' to the resilient member 2 is carried out by bonding them together into an integral complex simultaneously upon the resilient member 2 molded between the rigid members 3 and 3'.

The sides of the resilient member 2 can be of any suitable configuration, such as flat, concavely arcuate, concavely spherical, etc.

A single resilient material, such as polyurethane rubber or chloroprene rubber, which has elastic properties corresponding to JIS-A hardness 40 degress JIS-D hardness 76 degrees, or a filler-loaded resilient material of a suitable type, may be used as the resilient member 2. For the rigid members 3 and 3', a metallic material such as soft steel, hard steel, or cast iron or steel, or a non-metallic material such as ceramic or the like can be used.

Figure 3:
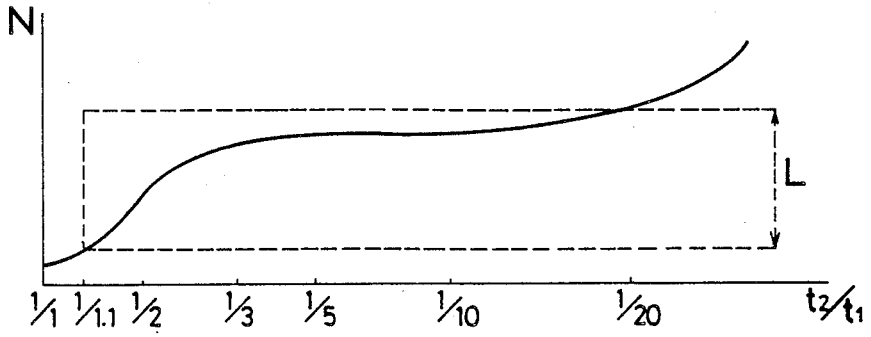
FIG. 3 is a diagramatic representation showing the relationship between the thickness ration and number of compressive fatigue repetitions.
Figure 4:
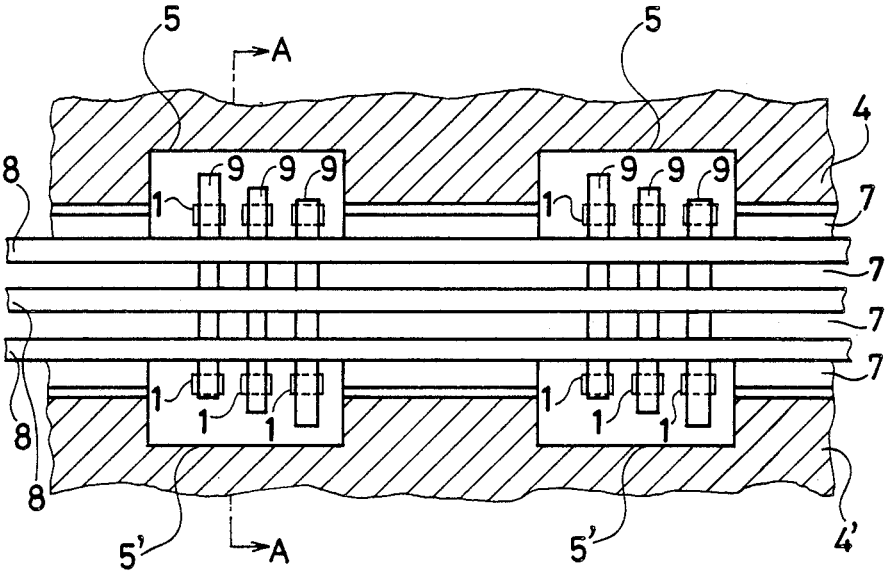
FIG. 4 is a plan view, partially cutaway, showing the pad of the invention as it appears when attached to an expansion joint.
Figure 5:
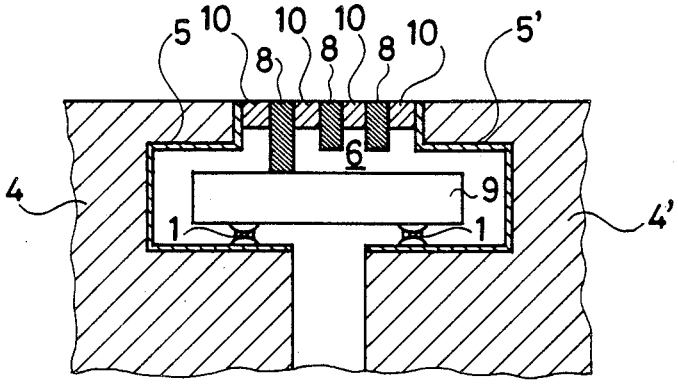
FIG. 5 is a sectional view taken along the line A—A in FIG. 4.

FIG. 3 is a diagram showing the relationship between the thickness ration $t^2/t^1$, wherein $t^2$ is an inner central thickness of the resilient member 2, between the apexes of concavely spherical surfaces a and a', and the thickness $t^1$ is an outer edge portion thereof. The number of compressive fatigue repetitions is shown as N. The materials used for the resilient member 2 is a polyurethane rubber having a JIS-A hardness of 95 degrees and the rigid member 3 and 3' are made of soft steel SS41.

Judging from the optimum fatigue life range L as shown in FIG. 3, the $t^2/t^1$ ratio between 1/1.1 and 1/20 may be the most effective from practical and economical points of view.

Next, the operation of the pad according to the invention when attached to the existing expansion joint will be explained.

The expansion joint includes joint boxes 5 and 5' disposed at the suitable locations of the opposite portions 4 and 4' of the road. A plurality of rods 8 are disposed with intervals 7 in longitudinally parallel relation in a space 6 defined between the road portions. The rods 8 are individually fixed to a plurality of crosspieces 9. These crosspieces 9 are mounted across a pair of joint boxes 5 and 5' and spaced apart parallel to one another. In each of the intervals 7, there is fitted a removable seal 10.

In the expansion joint, each pad 1 is interposed between the crosspieces 9 and bottom of the joint boxes 5 and 5' to support the crosspieces 9. If any displacement occurs in the inter-road space 6 as a result of any temperature variations or the like, the crosspiece 9 moves on the pad 1. Constructed as described above, the pad 1 permits smooth movement of the crosspiece 9 in such case and exhibits sufficient strength characteristics to sustain a live load transmitted through the rods 8 and crosspiece 9. That is, the pad 1 is able to moderately absorb the displacement due to the live load of the ends of the crosspiece 9 and further to restrain any compressive deformation due to the live load. This is attributable to the fact that the volume of the resilient member 2 is reduced at the central portion thereof as compared with the conventional one so that the resilient member 2 is less subject to molecular migration therein during any compressive deformation, whereby compressive deformation is prohibited.

Further, the fact that, as stated above, the resilient member 2 is subject to less molecular migration therein assures an improved repeated-fatigue life.

In the above described embodiment, the curved surfaces are spherical. Alternatively, some other smooth form of curved surface, such as cylindrical, for example, may be employed. In such case, the pad 1 is disposed so that the longitudinal axis of the cylindrical surface profile is rectangular to the crosspiece 9.

Figure 6:
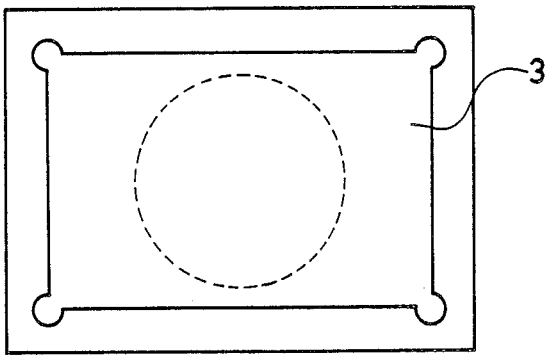
FIG. 6 is a plan view of another embodiment.
Figure 7:
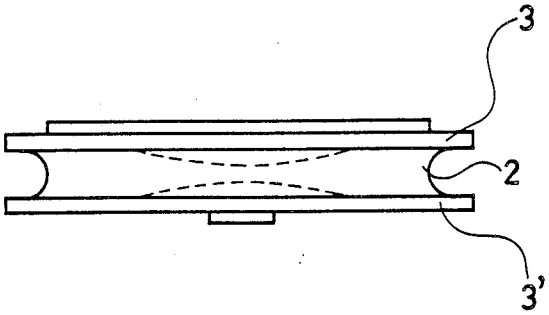
FIG. 7 is a front view thereof.

As is shown in FIGS. 6 and 7, it is also possible to use a configuration wherein the curved surfaces are reduced in size relative to the rigid member 3 and resilient member 2. This configuration provides an advantage in that if the resilient member 2 expands transversely by a load exerted on the rigid member 3, there is no possibility of the resilient member protruding beyond the rigid member 3 or is corner portion being cut away.

As may be clearly understood from the above description, the pad in accordance with the invention has sufficient strength to support crosspieces in expansion joints. Further, the pad can adequately absorb any displacement occuring due to a live load in each crosspiece at the ends thereof and restrains any compressive deformations due to the live load.

What is claimed:

1. A crosspiece supporting pad in a structural construction member, comprising a resilient member having concavely spherical surfaces on its upper and lower sides, and a pair of rigid members each having a convexly spherical surface which mates with said concavely spherical surfaces, said concavely and convexly spherical surfaces each having apexes which are respectively provided above and below the apexes of the mating spherical surfaces, said rigid members bieng respectively fixed to the upper and lower sides of said resilient member with their convexly spherical surfaces respectively held in mating relation with the concavely spherical surfaces of said resilient member.

2. The pad as set forth in claim 1, wherein said resilient member has its upper and lower spherical surfaces formed in such a way that an apex of said upper spherical surface lies above an apex of said lower spherical surface.

3. The pad as set forth in claim 2, wherein the ratio of thickness of the resilient member between said apexes to the thickness of its outer edge portion is in the range of 1/1.1 to 1/20.

4. The pad as set forth in any one of claim 1, wherein said upper and lower spherical surfaces are of an identical configuration.

5. The pad as set forth in claim 2, wherein said upper and lower spherical surfaces are of an identical configuration.

6. The pad as set forth in claim 3, wherein said upper and lower spherical surfaces are of an identical configuration.

* * * * *